US007320461B2

(12) United States Patent
Lofthus et al.

(10) Patent No.: US 7,320,461 B2
(45) Date of Patent: Jan. 22, 2008

(54) MULTIFUNCTION FLEXIBLE MEDIA INTERFACE SYSTEM

(75) Inventors: Robert M. Lofthus, Webster, NY (US); Kristine A. German, Webster, NY (US); David K. Biegelsen, Portola Valley, CA (US); Joannes N. M. deJong, Hopewell Junction, NY (US); Lloyd A. Williams, Mahopac, NY (US); Warren B. Jackson, San Francisco, CA (US)

(73) Assignee: Xerox Corporation, Norwalk, CT (US)

( * ) Notice: Subject to any disclaimer, the term of this patent is extended or adjusted under 35 U.S.C. 154(b) by 552 days.

(21) Appl. No.: 10/860,195

(22) Filed: Jun. 3, 2004

(65) Prior Publication Data

US 2004/0247365 A1 Dec. 9, 2004

Related U.S. Application Data

(60) Provisional application No. 60/478,749, filed on Jun. 16, 2003, provisional application No. 60/476,374, filed on Jun. 6, 2003.

(51) Int. Cl.
*B65H 5/22* (2006.01)

(52) U.S. Cl. ..... 271/3.14; 271/9.01; 271/9.05; 271/9.11; 271/9.12

(58) Field of Classification Search ..... 271/9.01, 271/9.05, 9.11, 9.12, 9.13, 3.14
See application file for complete search history.

(56) References Cited

U.S. PATENT DOCUMENTS 3,861,673 A 1/1975 Ticknor
4,123,113 A 10/1978 Koss
4,411,418 A 10/1983 Poehlein
4,438,917 A 3/1984 Janssen et al.
4,511,242 A 4/1985 Ashbee et al.
4,519,700 A 5/1985 Barker et al.
4,579,446 A 4/1986 Fujino et al.
4,587,532 A 5/1986 Asano
4,618,292 A 10/1986 Judge et al.
4,733,856 A 3/1988 Gunther, Jr.

(Continued)

OTHER PUBLICATIONS

U.S. Appl. No. 10/761,522, filed Jan. 21, 2004, Mandel et al.

(Continued)

*Primary Examiner*—David H Bollinger
(74) *Attorney, Agent, or Firm*—Eugene O. Palazzo; Fay Sharpe LLP

(57) ABSTRACT

A flexible media integration system (10) includes a multifunction flexible media interface system (12). The interface system includes a plurality of flexible media input areas (22, 24, 26) for receiving flexible media (14), such as sheets of paper, from a plurality of associated input processors (16, 18, 20), such as printers or paper feeders. A plurality of flexible media output areas (32, 34) provide outputs to different associated flexible media output processors (36, 38), such as printers or finishers. The interface system also includes a sheet position sensing system (52) and a sheet transporting system (42). The transporting system provides selectable flexible media translation for selectably transporting flexible media from selected ones of the plurality of flexible media input areas to selected ones of the plurality of flexible media output areas so as to provide selectable flexible media feeding from selected flexible media input processors to selected flexible media output processors.

21 Claims, 10 Drawing Sheets

U.S. PATENT DOCUMENTS 4,836,119 A 6/1989 Siraco et al.
4,971,304 A 11/1990 Lofthus
5,004,222 A 4/1991 Dobashi
5,078,384 A 1/1992 Moore
5,080,340 A 1/1992 Hacknauer et al.
5,094,442 A 3/1992 Kamprath et al.
5,095,342 A 3/1992 Farrell et al.
5,100,116 A 3/1992 Graushar
5,156,391 A 10/1992 Roller
5,159,395 A 10/1992 Farrell et al.
5,167,300 A * 12/1992 Yoshida et al. ..... 186/37
5,169,140 A 12/1992 Wenthe, Jr.
5,203,552 A * 4/1993 Hoshi et al. ..... 271/9.01
5,208,640 A 5/1993 Horie et al.
5,272,511 A 12/1993 Conrad et al.
5,273,274 A 12/1993 Thomson et al.
5,278,624 A 1/1994 Kamprath et al.
5,326,093 A 7/1994 Sollitt
5,389,969 A 2/1995 Suzuki et al.
5,435,544 A 7/1995 Mandel
5,462,399 A 10/1995 Clupper et al.
5,473,419 A 12/1995 Russel et al.
5,489,969 A 2/1996 Soler et al.
5,504,568 A 4/1996 Saraswat et al.
5,525,031 A 6/1996 Fox
5,547,225 A 8/1996 DeAngelis
5,557,367 A 9/1996 Yang et al.
5,568,246 A 10/1996 Keller et al.
5,570,172 A 10/1996 Acquaviva
5,592,881 A 1/1997 Rabjohns
5,596,416 A 1/1997 Barry et al.
5,629,762 A 5/1997 Mahoney et al.
5,634,636 A 6/1997 Jackson et al.
5,687,964 A 11/1997 Stephan et al.
5,710,968 A 1/1998 Clark et al.
5,778,377 A 7/1998 Marlin et al.
5,810,346 A 9/1998 Jorg
5,884,910 A 3/1999 Mandel
5,995,721 A 11/1999 Rourke et al.
6,059,284 A 5/2000 Wolf et al.
6,075,924 A 6/2000 Will
6,125,248 A 9/2000 Moser
6,125,760 A 10/2000 Graushar et al.
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,559,961 B1 5/2003 Isernia et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,735,332 B1 5/2004 Goldberg et al.
6,819,906 B1 11/2004 Herrmann et al.
7,043,309 B2 5/2006 Jackson et al.
7,226,049 B2 * 6/2007 Lofthus et al. ..... 271/185
2002/0078012 A1 6/2002 Ryan et al.
2002/0103559 A1 8/2002 Gartstein
2003/0002447 A1 1/2003 Jackson et al.
2003/0077095 A1 4/2003 Conrow
2003/0080486 A1 5/2003 Ifkovits et al.
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2004/0253033 A1 12/2004 Lofthus et al.

OTHER PUBLICATIONS

U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/069,020, filed Feb. 28, 2005, Lofthus et al.
U.S. Appl. No. 11/081,473, filed Mar. 16, 2005, Moore.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
"Xerox Disclosure Journal", publication of Nov.-Dec. 1991, vol. 16, No. 6, pp. 381-383 by Paul F. Morgan.
"TAX" publication "Cluster Printing Solution Announced" (Aug. 3, 2001).

* cited by examiner

MULTIFUNCTION FLEXIBLE MEDIA INTERFACE SYSTEM

This application claims the benefit of Provisional Patent Application Nos. 60/476,374, filed Jun. 6, 2003, and 60/478,749, filed Jun. 16, 2003, the disclosures of which are incorporated herein in their entireties, by reference.

BACKGROUND

The present exemplary embodiment relates to a flexible media integration system. In particular, it relates to a system for receiving sheets from plural inputs, such as printers, and selectably directing those sheets to plural sheet outputs, such as finishers, and will be described with particular reference thereto. However, it is to be appreciated that the present exemplary embodiment is also amenable to other like applications.

In a typical copying/printing apparatus, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with developing powder referred to in the art as toner. This image may subsequently be transferred to a support surface, such as copy paper, to which it may be permanently affixed by heating and/or by the application of pressure, i.e., fusing.

In a conventional printing apparatus, sheet material or paper is handled by a series of rollers and counter rollers. The counter roller generates forces normal to the tangential surface of a roller for handling the sheet. Counter rollers, however, sometimes lead to jams, paper tears, wrinkling, or other surface damage to the sheet. The normal operation of the printer may be interrupted for some time while the damaged sheets are removed.

Additionally, traditional rollers form what is know in the field as a non-holonomic sheet transport system because only a limited number of directions of movement are possible for the sheet at a given time. Where sheets are to be merged, an interposer or sheet inserter is used. Examples of such sheet inserters are disclosed, for example, in U.S. Pat. No. 6,559,961 to Isernia, et al. and U.S. Pat. No. 5,995,721 to Rourke, et al. Isernia, et al. discloses a system for printing jam-prone sheets. These are printed as separated pages prior to printing any of the other electronic pages. The system temporarily holds them in an interposer, then prints the other pages of the document onto normal sheets, and provides collated merging in the interposer to provide collated output of the entire electronic document. Rourke, et al. discloses a queuing system for examining document attributes and delivering one or more portions of the document to one or more document processing subsystems and then merging the document portions. Such systems often add to the cost, complexity, and the length of the paper path.

U.S. Pat. Nos. 6,607,320 to Bobrow, et al., and 6,554,276 to Jackson, et al., the disclosures of which are incorporated herein in their entireties by reference, disclose an apparatus for processing a substrate on two sides. The apparatus of Bobrow includes an input pathway for receiving the substrate from a substrate processing station, a station for processing the face-up side of the substrate, a reversion pathway for reverting the substrate and returning the reverted substrate to the input pathway. A merge point merges the reverted substrate into the input pathway for processing the face-up side of the substrate in the print station. The substrate is manipulated in the reversion pathway by a plurality of air jets. In the systems of Bobrow and Jackson, however, all the sheets start and finish on the input pathway.

As demands for increased output from printing systems increase; printers with marking engines capable of operating at increasingly higher prints per minute (ppm) have been developed. As the speed of the printer is increased, tolerances become harder to satisfy and reliability tends to be more difficult to maintain. Additionally, since the components of a printing system are arranged in series, each component should be capable of performing at the higher speed so that the benefits of higher speeds which could be obtained in one component are not lost by the slower speeds necessitated by another component.

The present embodiment provides a flexible media integration system which overcomes the above-referenced problems, and others.

BRIEF DESCRIPTION

In accordance with one aspect of the present exemplary embodiment, a multifunction flexible media interface system is provided. The system includes a plurality of flexible media input areas for receiving flexible media from a plurality of associated input processors, a plurality of flexible media output areas for providing outputs to different associated flexible media output processors, a flexible media position sensing system, and a flexible media transporting system. The flexible media transporting system provides selectable flexible media translation for selectably transporting flexible media from selected ones of said plurality of flexible media input areas to selected ones of said plurality of flexible media output areas so as to provide selectable flexible media feeding from selected flexible media input processors to selected flexible media output processors.

In accordance with another aspect of the present exemplary embodiment, a method of conveying flexible media between a plurality of input processors and a plurality of output processors is provided. The method includes inputting flexible media to a selected one of a plurality of flexible media input areas. Each of the input areas is associated with an input processor. The method further includes delivering the received flexible media from the selected one of the plurality of flexible media input areas to a selected one of a plurality of flexible media output areas. Each of the flexible media output areas is associated with an output processor. A position of the flexible media is sensed. Selectable translation of flexible media from any one of the plurality of flexible media input areas to any one of the plurality of flexible media output areas is achieved.

In accordance with another aspect of the present exemplary embodiment, a multifunction flexible media integration system is provided. The integration system includes a flexible media interface. The interface is modular, scalable, reconfigurable, adapted for interfacing with at least one of multiple identical printers and multiple different printers, and capable of providing functionally redundant parallel paper paths connecting said printers with a plurality of output processors. The interface is configured and controlled such that any selected final output to the output processors can be achieved through multiple different sequences of operations. The integration system is optionally capable of at least one of processing more than one job simultaneously and printing sequential images from more than one printer on the same side of a page. The integration system further includes a plurality of printers which interface with the interface system and a plurality of output processors which interface with the interface system.

The term "marking device" as used herein broadly encompasses various printers, copiers or multifunction machines or systems, xerographic or otherwise, unless otherwise defined in a claim.

A "printing system," as used herein incorporates a plurality of marking devices.

The term "sheet" herein refers to a usually flimsy physical sheet of paper, plastic, or other suitable physical print media substrate for images, whether precut or web fed. The term "sheet" also encompasses other generally planar items, whether to be printed or not, unless otherwise defined in a claim.

"Flexible media," as used herein, broadly encompasses print media substrates for images as well as other generally planar objects which are not necessarily undergoing an imaging process, including items of mail, banknotes, and the like.

A "print job" is normally a set of related sheets, usually one or more collated copy sets copied from a set of original document sheets or electronic document page images, from a particular user, or otherwise related.

A "finisher," as broadly used herein, is any post-printing accessory device such as an inverter, reverter, sorter, mailbox, inserter, interposer, folder, stapler, stacker, collater, stitcher, binder, over-printer, envelope stuffer, postage machine, or the like.

DETAILED DESCRIPTION

Figure 1:
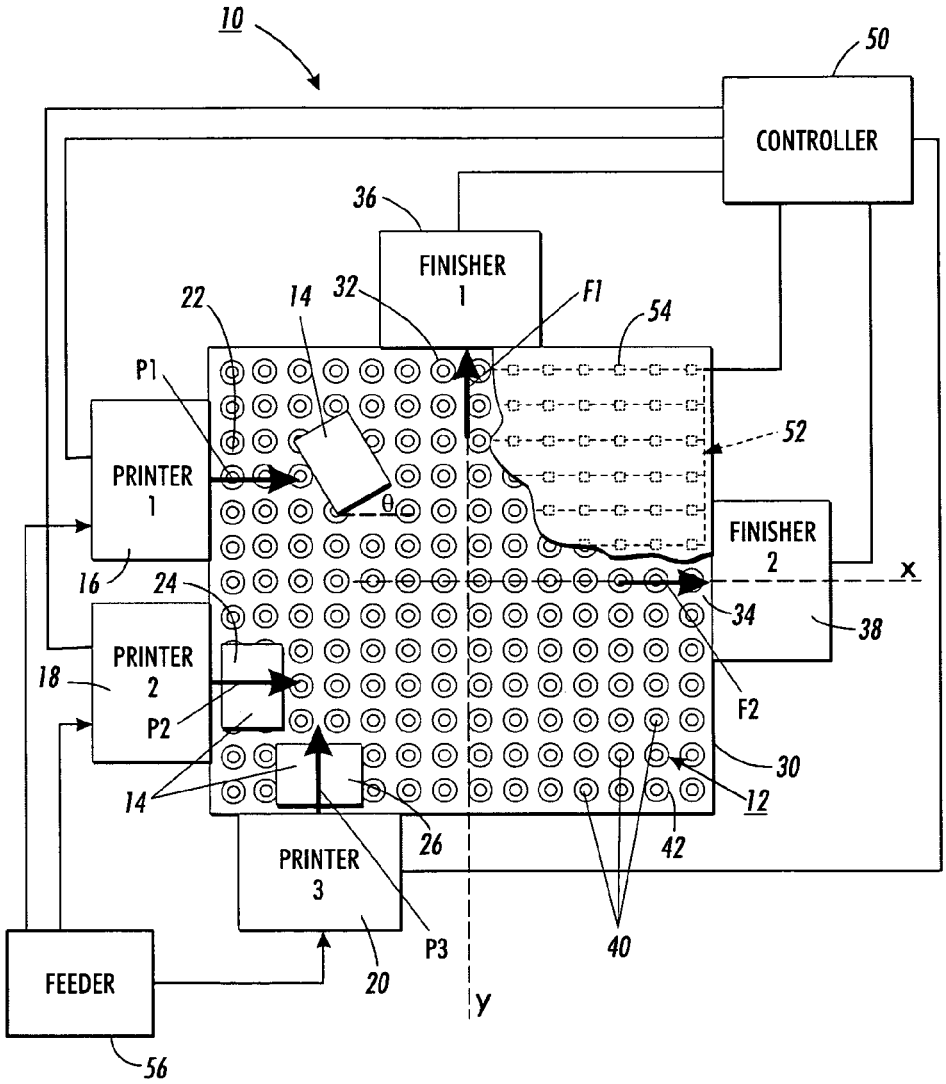
FIG. 1 is a schematic top view of a first embodiment of a multifunction flexible media interface system.

Disclosed in the embodiment herein is a flexible integration system for receiving flexible media, such as sheets of paper, from plural input areas and selectably directing the flexible media to plural output areas. The input areas each receive sheets from an input processor, such as a printer or paper feeder, while the output areas output the flexible media selectably to different output processors, such as different finishers. The integration system may further incorporate a media position sensing system and a dual-axis flexible media transporting system, which may be integrated in a planar table device.

Generally, flexible media can include any flexible objects that can be adapted to be transported by the transport system, such as for example, sheets of paper, items of mail, banknotes, or the like. While specific reference is made herein to the transportation of sheets, it will be appreciated that the transportation of other flexible media is also contemplated.

Where the integration system comprises, in whole or in part, a printing system, the input processor can include a printer, paper feeder, inverter, reverter, or other device which handles paper in the printing system. In the case of a paper feeder, both automated and manual paper feeding systems are contemplated. The output processor can include a finisher, printer, or other device which receives sheets directly or indirectly from the output area. In other flexible media handling systems, such as mail handling and bank note handling systems, the input source may be a sorter, scanner, or other suitable device. While particular reference is made to printers as input processors and finishers as output processors, it is to be understood that other input and output devices are also contemplated.

The flexible media transporting system provides selectable sheet translation movement and/or rotation from selected ones of the plural input areas to selected ones of the plural outputs areas so as to provide selectable sheet feeding from selected marking devices, or other input processors, to selected output processors.

A large area of multiple spaced sheet driving elements (providing variable angle sheet driving directions) and sensors may be provided in an intelligent, adaptive, scaleable, closed-loop paper path plane, which can simultaneously enter, exit, move and re-position multiple sheets thereon. Any sheet entering at any position can be moved to any other location in the paper path plane. With a variable velocity as well as variable angle sheet movement system in the disclosed embodiment, the outputs of slower prints per minute (ppm) printers with slower sheet velocities can be combined into a single or plural sheet output stream of higher velocities and ppm rates. Continuous feedback sensing of sheet positions can be provided.

With one or more of the disclosed embodiments, the inputs and outputs of plural lower speed printers, different paper feeders and different output devices can be more readily and flexibly combined into collated print jobs with the printing speed of a much higher speed printer. Redundant marking devices also allow fault tolerance and repair without downtime. Replacement/repair of any one marking device simply puts an area of the interface system temporarily or permanently out of bounds. For example, two (or more) printers running in parallel can produce a serial output which is, in theory, up to the sum of the two (or more)

individual outputs. However, if one of the printers is temporarily out of service, the serial output is reduced, but a print job can still be completed. Alternatively, the output of the remaining printer(s) can be increased to maintain the overall desired throughput.

Although not limited thereto, incorporated by reference, where appropriate, by way of background, are the following references variously relating to what have been variously called "tandem engine" printers, "parallel" printers, or "cluster printing" (in which an electronic print job may be split up for distributed higher productivity printing by different printers, such as separate printing of the color and monochrome pages), "output merger" or "interposer" systems, etc. For example, Xerox Corp. U.S. Pat. No. 5,568,246 to Keller, et al.; Canon Corp. U.S. Pat. No. 4,587,532 to Asano; Xerox Corp. U.S. Pat. No. 5,570,172 to Acquaviva; T/R Systems U.S. Pat. No. 5,596,416 to Barry, et al.; Xerox Corp. U.S. Pat. No. 5,995,721 to Rourke et al; Canon Corp. U.S. Pat. No. 4,579,446 to Fujino, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced." One example of a Xerox Corp. sheet "interposer" patent is Xerox Corp. U.S. Pat. No. 5,489,969 to Soler, et al. Also noted are commonly assigned Xerox Corp. U.S. Pat. Nos. 6,554,276, to Jackson, et al., and 6,607,320, to Bobrow, et al., for sheet positioners and sheet "reverters".

By way of an example of a variable vertical level, rather than horizontal, "universal" input and output sheet path interface connection from a single printer to a single finisher, there is Xerox Corp. U.S. Pat. No. 5,326,093 to Sollitt. This patent is noted and incorporated as demonstrating that additional possible optional input and/or output features may be used here, since various different printers and third party finishers may have different sheet output levels and sheet input levels.

Figure 9:
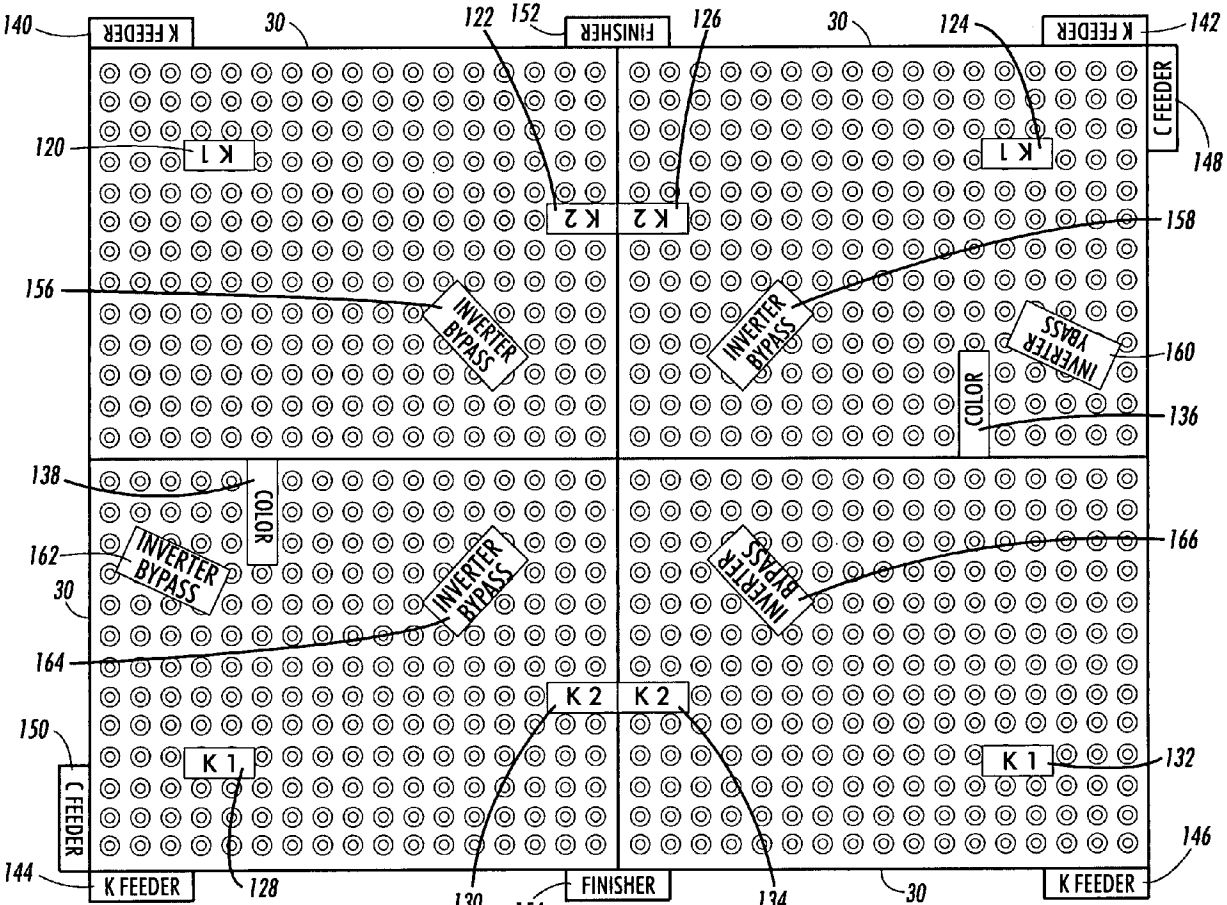
FIG. 9 is a schematic top view of a fifth embodiment of a multifunction flexible media interface system.

Various large area multiple optical sensor arrays, such as with light emitting diodes (LEDs) and multiple pixel photocells, with SELFOC or other collimating lenses, may be used, and are also known in the art, and in the imaging bar art, and need not be described in detail herein. Particularly noted and incorporated by reference herein is U.S. Pat. No. 6,476,376 to Biegelsen, et al. FIGS. 9 and 11 thereof are noted in particular. Various large area two-dimensional optical object orientation and/or recognition sensors, such as overhead video cameras and associated software, are also known.

A specific feature of several specific embodiments disclosed herein is to provide a multifunction printed sheets interface system, comprising plural sheet input areas for receiving printed sheets from plural printers, plural sheet outputs areas for plural outputs to different sheet processors, a sheet position sensing system, and a sheet transporting system, the sheet transporting system providing selectable sheet translation for selectably transporting sheets from selected ones of the plural sheet input areas to selected ones of the plural sheet output areas so as to provide selectable sheet feeding from selected printers to selected sheet processors.

Further specific features disclosed in several of the embodiments herein, individually or in combination, include those wherein the sheet transporting system additionally provides selectable sheet rotation of selected sheets; and/or wherein the sheet transporting system additionally provides selectable sheet merging in a selected sheet sequence of sheets from the plural printers to a selected sheet processor; and/or wherein the sheet transporting system comprises a multiplicity of spaced and independently operable variable-sheet-feeding-direction sheet transports; and/or wherein the sheet transporting system is a generally planar sheet feeding table larger than the dimensions of any sheet to be fed thereon for simultaneous plural sheet variable transport thereon; and/or wherein the sheet transporting system has a large planar area with a multiplicity of spaced apart independently operable variable sheet feeding direction and sheet velocity sheet transports, the large planar area being substantially larger than the dimensions of any sheet to be fed thereon to allow simultaneous plural sheet variable transport thereon by the multiplicity of spaced apart independently operable variable sheet feeding direction and sheet velocity sheet transports, the sheets being sensed thereon by the sheet position sensing system, and the sheet position sensing system controlling the multiplicity of spaced apart independently operable variable sheet feeding direction and sheet velocity sheet transports.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims.

With reference to FIG. 1, which schematically shows a top view of a first embodiment of a flexible integration system 10, a large area planar multifunction printed sheets interface system or interposer 12 is adapted to receive an input of printed sheets 14 from schematically illustrated, selectable and repositionable input processors 16, 18, 20, which may be otherwise conventional, exemplified herein as printers. The printers 16, 18, 20 all feed their printed sheets outputs to selectable different input areas 22, 24, 26 on this exemplary printed sheets interface system 12, although it is to be appreciated that the input areas may be wholly or partially overlapping. The interface system 12 includes a variably selectable sheet transporting system, here comprising generally planar sheet feeding table 30 which is larger than the dimensions of any sheet 14 to be fed thereon, with variably selectable input paths P1, P2, and/or P3 from the printers 16, 18, and 20 and output paths F1, F2, in this example, to output areas 32, 34 associated with selectable and repositionable output processors, exemplified by finisher units 36 and/or 38, which may be otherwise conventional. For example, the table 30 may be sized to accommodate a plurality of sheets, e.g., two, four, ten, or more sheets, thereon simultaneously.

The interface system 12 comprises a multiplicity of spaced apart and independently operable variable sheet feeding direction and sheet feeding velocity sheet transports 40 supported by the table, which are arranged in an array to define a two dimensional transport plane or sheet transporting system 42 in which sheets travel. The sheet transports 40 are independently controlled by a controller 50 to drive the sheets from any input processor to any output processor, with or without sheet rotation, by their variable angle driving. The spacings between the transports 40 are closer than the smallest sheet to be fed. The controller 50 is also operatively connected to a large area sheet position sensor system 52 distributed over the table 30 area. The sensor system 52 may include a plurality of spaced sensor modules 54 for simultaneously sensing the positions (e.g., x,y coordinates of one or more points on a sheet) of a plurality of sheets and signaling the positions to the controller 50.

FIGS. 3-9 show alternative embodiments of interface systems which may be similarly configured.

The sensor modules 54 may be configured as described in U.S. Pat. No. 6,476,376, incorporated by reference, and interconnected in an array 42 such that for any sheet location and orientation on the interface system 12, at least one sensor module 54, and in one embodiment, a plurality of sensor modules, is sensing the sheet position.

Using a sensor system 52 such as that of the Biegelsen U.S. Pat. No. 6,476,376 permits sensing the size (e.g., area or perimeter length), shape, and location orientation as well as the position of one or more objects in two dimensions. This facilitates moving sheets through the interface system and allows multiple sheets to be transported at the same time, optionally at different speeds and/or in different directions. By sensing one or more of size, shape, and location orientation and position continuously, or at short time intervals, the system can react to changes in the sheet speed or direction while the sheet is in transport. Thus, for example, minor unplanned changes in sheet direction or speed can be corrected as the sheet is in transport. Dynamic programmable routing of sheets is also possible, enabling sheets from any input processor to be selectably transported in any direction, without the need for building of fixed paths with fixed translations and rotations.

Figure 10:
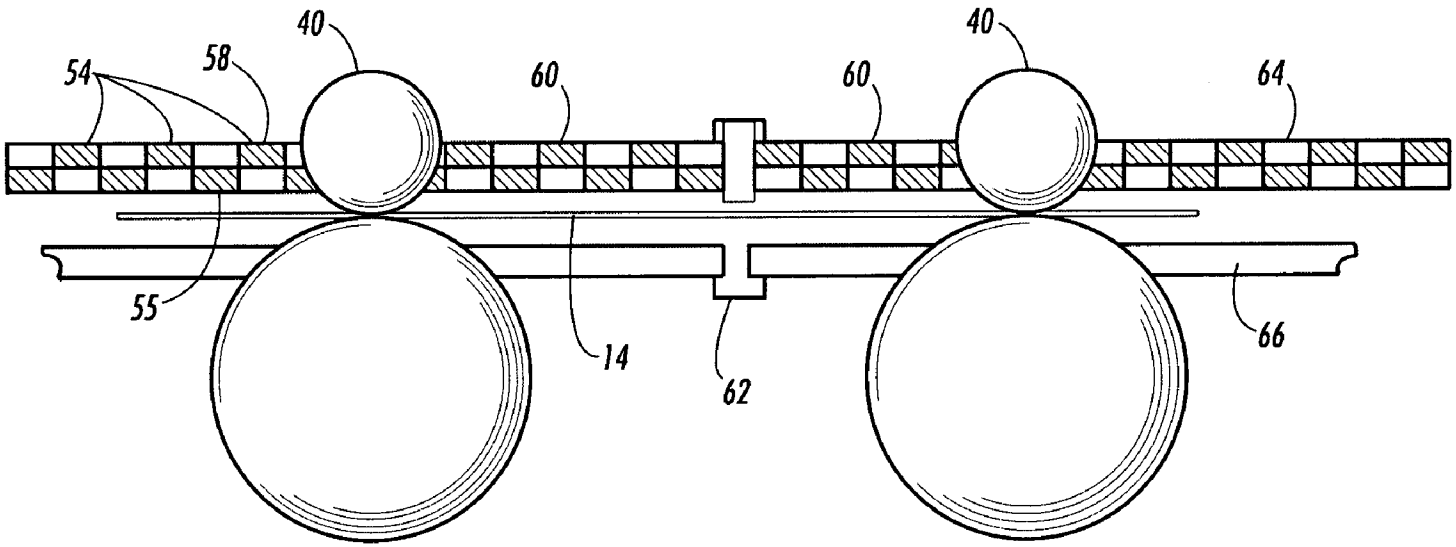
FIG. 10 is a schematic sectional view of two adjacent tiles incorporating sensors and transport modules suited to use in the multifunction flexible media interface system of FIGS. 1 and 3-9, where arrows indicate the paths of light from light sources to detectors.

In one embodiment, the sensor system 52 is capable of detecting at least one of a presence, a position, a size, a shape and an orientation of a sheet using a plurality of discrete light energy detectors 55 distributed over the plane (FIG. 10), each discrete light energy detector having a two dimensional detection surface. The light energy detectors are arranged in two dimensions such that the detection surfaces of the plurality of light energy detectors substantially fill the plane, or a significant portion thereof (e.g., at least 10%, in one embodiment, at least 50%). When a sheet 14 passes in proximity to the plurality of discrete light energy detectors, light energy emitted from a plurality of light sources 58 is received by at least some of the plurality of light energy detectors. A signal is transmitted from each of the light energy detectors based on an amount of received light energy received at each light energy detector. The presence, position, size, the shape and/or the orientation of the sheet is determined, based on the transmitted signals from the light energy detectors.

Knowing the size and/or shape of a sensed object permits a sorting function whereby media entering the interface system 12 is directed to a selected output destination according to its sensed size and/or shape. For example, all media of at or above a selected size are transported to a first output destination while media of at or below the selected size are transported to a second output destination. In one embodiment, sorting according to size and/or shape serves a quality control function, with objects which fall outside a predetermined acceptable range of size and/or shape being sent to a "reject" output destination. It will be appreciated that area, perimeter, and/or shape can be a surrogate for total mass, size, surface area, or the like of an object, assuming other properties of the object are known. Thus, for example, if it is desired to reject objects of above a certain mass, objects having greater than a predetermined area can be rejected, knowing the approximate density and thickness of the objects. The sensor system 52 is optionally capable of differentiating curved perimeters, such as circles, from linear perimeters, such as squares, rectangles, and triangles, and even of differentiating between one type of linear perimeter, such as a square, from another, such as a triangle, by determining a relationship between two linear portions of the perimeter, e.g., an angle therebetween or a length ratio.

By knowing the size, shape, and/or orientation of the media, packing efficiencies can be achieved, thereby allowing more sheets to be located on the interface system 12 at any one time. For example, if a finisher is located at an angle $\theta$ to a printer or other location from which it receives sheets, it may be more efficient to rotate the sheets through an angle of approximately $\theta$ such that a longest edge of the sheet is oriented generally perpendicular to the direction of travel. The sensor system 52 senses the angle of the sheet during rotation, allowing the transport modules 40 to achieve the desired orientation.

The sheet transports 40 are arranged in a plane of multiple, spaced transports, which, in cooperation with the sensor modules 54, provide variable angle sheet driving directions in an intelligent, adaptive, scaleable, closed loop paper path plane, which can simultaneously enter, exit, move and re-position multiple sheets thereon. Any sheet entering at any position can be moved to any other location in the paper path plane. The transports provide a variable velocity as well as a variable angle sheet movement system.

The flexible media may be constrained to move within the plane by baffles 64, 66 (FIG. 10) located above and below the plane. The baffles substantially limit the ability for the media to move in a direction out of the plane. Thus, the media is essentially limited to movement only within the XY plane. In one embodiment, the sensors 54 are mounted within the baffles 64 and/or 66, or are mounted to interior surfaces of the baffles such that even if the baffles are opaque or occluded, the sensors are capable of sensing the position of the media. In the illustrated embodiment, the detectors 55 and light sources 58 are all located on the same side of the plane, although it is to be appreciated that the detectors may be located on an opposite side of the plane to the light sources. Other possible arrangements are illustrated, for example, in U.S. Pat. No. 6,476,376 to Biegelsen, incorporated herein by reference.

Where input processors 16, 18, 20 comprise printers, a sheet feeding unit 56 may feed sheets to each of the printers. Alternatively, each printer is provided with an individual sheet feeding unit (not shown). In the illustrated embodiment, feeder 56 does not feed sheets directly to the interface system 12, although it will be appreciated that a sheet feeder may provide a direct feed (serving as an input processor), as described in greater detail below.

The controller 50 may also be operatively connected to the clustered printers 16, 18, and 20 and/or the optional finisher units 36 and 38. The number of sheet inputs and outputs, and their locations, which can be provided by the interface system 12 is completely flexible. Only the software, not the hardware, need be changed for such different applications and functions.

In one embodiment, the controller 50 incorporates or interfaces with a scheduling system for planning the order of printing documents and/or the paths through the interface system 12 of each of the sheets which comprise a document. U.S. Published Application Nos. 2004/0085561, 2004/0085562, and 2004/0088207 to Fromherz, published May 6, 2004, which are incorporated herein in their entireties by reference, disclose exemplary scheduling systems which are suited to use with a reconfigurable printing system including the interface system 12. Such a scheduling system may be used to schedule the order of printing and routing of each of the sheets between input and output devices 16, 18, 20, 36, 38 allowing several spaced sheets to be in transit on the interface system at any one time, each of the sheets optionally moving in different directions and at different sheet velocities.

The sheet transports 40 may comprise spherical nips ("SNIPS") spin-roller drives, airjet transport modules, omni-directional drive systems, spherical paper moving devices, belt drives, conventional cylindrical roller nip drives, or the like. An example of a SNIPS paper moving device for two-axis sheet movement and/or rotation is described in U.S. Pat. No. 6,059,284 to Wolf, et al., the disclosure of which is incorporated by reference in its entirety. As disclosed in U.S. Pat. No. 6,059,284, each SNIPS sheet drive has a spherical frictional drive ball engaging any overlying sheet, which drive ball is rotated in any desired direction and speed by two orthogonal servo-driven rollers drivingly engaging the opposite side of the ball. The exemplary multiple selectively directional (variable drive angle) sheet transports 40 may thus be schematically represented herein, and need not be described in detail herein. Similar transport systems which may be employed are disclosed in U.S. Pat. No. 4,836,119 to Siraco, et al. and U.S. Pat. No. 6,241,242 to Munro, incorporated herein by reference in their entireties. Overlying idler balls, pneumatic pressure or suction, or other known paper feeding normal force systems may be added, if desired, to hold the sheets down against the drive balls in addition to sheet gravity.

An airjet transport system is generally a paper transport system that uses flowing air instead of rollers to apply the motive force to the paper sheets to move the flexible sheet. The system controller 50 interacts with individual or local module controllers for the various airjets.

The airjet transport, spherical nips, omni-direction drive, or two-way NIPs are all examples of transport mechanisms which are capable of moving a body in any direction in a plane defined by mutually perpendicular x and y axes as well as rotation, within the plane, through any angle θ (i.e., three degrees of freedom). Such systems are sometimes referred to as holonomic systems. These embodiments can move the part in any direction, including velocity direction, at any time, not just the axes perpendicular to the roller axis as in traditional transport systems.

Examples of a two-way roller system that can be used herein are disclosed in U.S. Pat. Nos. 6,607,320 and 6,554,276, incorporated herein by reference. The two-way rollers permit motion in directions at non-perpendicular angles to the roller axle. In one embodiment, a number of two-way rollers are grouped into perpendicular arrays so that a force in any arbitrary direction within the plane can be exerted on the object by appropriate torque applied to the rollers in the two orthogonal directions. The object is free to move in that direction in response to the force because of the two-way roller action. Arrays of such rollers form holonomic actuators that can be used with the present transport system in that they can provide motion in any direction at any time.

The transport system of SNIPS, airjets, or other sheet transports 40 enables paper sheets to be transported in at least two directions which are angularly spaced from one another. In its simplest form, the paper sheets are transportable along two orthogonal axes, although it is to be understood that the axes may be situated at any convenient angle to one another, e.g., at an angle of from 45-135°. In the case of SNIPS or airjets, the direction of travel may be variable across a wide range of angles. Additionally, in one embodiment, rotation as well as translation of the sheet can be effectuated by the sheet transports 40.

It will be appreciated that printers 16, 18, 20 and finishers 36, 38 can be used in a variety of configurations. For example, at one time, a first printer 16 prints pages of one document which are conveyed by the interface system 12 to a first finisher 36, while a second printer 18 prints pages of a second document, which are conveyed to a second finisher 38. At another time, two printers 16, 20 of different print modalities (e.g., black and color) print portions of the same document, which are fed to the same finisher 36. At yet another time, two or more printers of the same print modality, e.g., two or more black printers 16, 18, print portions of the same document, which are fed to the same finisher 36. This allows a high output, in terms of ppm, without the need for high speed printers. For example, two (or more) printers 16, 18, can each be moderate speed printers, such as identical, 70 ppm black printers. When operated in parallel, printers 16 and 18 enable a serial output from the flexible integration system 10 of up to about 140 ppm, which is as higher than can currently be achieved with most single high speed printers. The interface system 12, in this embodiment, is capable of simultaneously transporting sheets from the two (or three printers) to a single finisher 36 and merging them into a single stream, e.g., in the input area 32. At the same time as the first document is being printed and transferred to the first finisher 36, a third printer 20 may print pages of another document which are transported by the interface system to a second finisher 38.

At yet another time, two or more of the printers may operate in series, e.g., for duplex printing, one of the printers printing a first side of a sheet. The interface system then transports the sheet to another printer, which prints the opposite side of the sheet before the interface system picks up the sheet once more and transfers it to a finisher.

It will be appreciated that the selection of printers and finishers can vary from document to document and within a document. For example, if one of the printers 16, 18, 20 goes offline due to a failure, another of the printers can be used to complete the document. For example, printers 16 and 18 may be operating in parallel to produce separate pages of a single document. At some time during the job, printer 16 is taken offline. Printer 18 completes the document, albeit at a somewhat slower speed than could have been achieved with both printers operating simultaneously. In one embodiment, the interface is configured and controlled such that any selected final output to the output processors can be achieved through multiple different sequences of operations. Thus, if one sequence of operations is not available, due, for example, to a failure of a component or a blockage in the paper path, the controller plans an alternative sequence of operations which allows the job to be completed.

The flexible integration system 10 provides additional flexibility in that when a small job is to be undertaken, one or more of the printers can be switched off.

The flexible integration system is also adaptive in that input and output processors 16, 18, 20, 36, 38, such as paper feeders, printers, and finishers, can be added, removed and/or or replaced, to meet the needs of the system. For example, a flexible integration system which has been using two black 40 ppm printers to meet a demand of 80 ppm can have an additional 40 ppm printer added to meet a higher demand of 120 ppm. Or, one or both of the existing printers can be replaced with a 70 or 120 ppm printer.

Input processors 16, 18, and 20 can be the same or different. For example, printers 16 and 18 may be black printers while printer 20 is a process (full) color or custom color (single color) printer. Printers 16 and 18, in this embodiment, may operate at the same speed, or run at different speeds.

Figure 2:
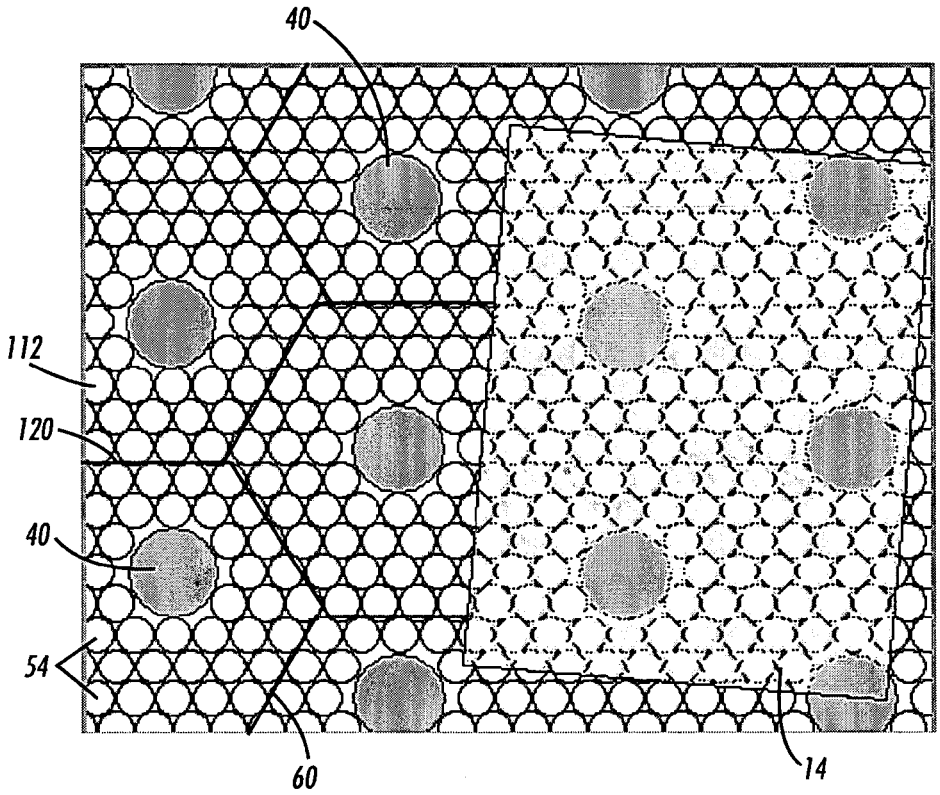
FIG. 2 is an enlarged schematic top view of the multifunction flexible media interface system showing a planar array of sensing modules and sheet driving modules.

The transports 40 may be selectively removable and repositionable. In one embodiment, illustrated in FIG. 2 (not to scale), at least one sheet transport 40 is incorporated into a removable tile 60, which can be selectively linked by means of suitable linkage mechanisms 62 (FIG. 10) to adjacent tiles 60 to form an array of tiles. In this way, interlocked planes of varying lengths and widths can be formed and reconfigured at will. The tiles 60 each include one or a plurality of the sheet driving elements 40 (e.g., airjets or SNIPS) and/or one or a plurality of the sensor modules 54.

For moving sheets of minimum dimensions of about 17.5 cm, the tiles may be formed as squares or hexagons of about 15 cm diameter.

The tiles 60 provide a modular interface system 10 which allows the integration system to be reconfigured by addition, removal and/or repositioning of tiles in the array. For example, an additional row or rows of tiles can be added so that an additional input or output processor can be interfaced with the interface system, i.e., the interface system 10 is scalable. Alternatively or additionally, one or more tiles from the center of the array can be replaced with input or output processors. Tiles of different shapes and sizes may be combined to produce the array.

In one embodiment, the tiles 60 are identically configured, the linking mechanisms 62 also being capable of linking to compatible linking mechanisms on input and output processors to provide a modular docking system whereby the locations and/or types of input and output processors can be reconfigured. In another embodiment, selected tiles are specially configured as docking tiles with docking elements (not shown) for linking with docking elements of the input and output processors.

While the interface system 12 has been described as existing in a single horizontal plane, it will be appreciated that the plane may be angled to the horizontal. Angled or curved surfaces may be incorporated, such as those described in U.S. Pat. Nos. 6,607,320 to Bobrow, et al., and 6,554,276 to Jackson, et al., incorporated herein by reference.

Figure 3:
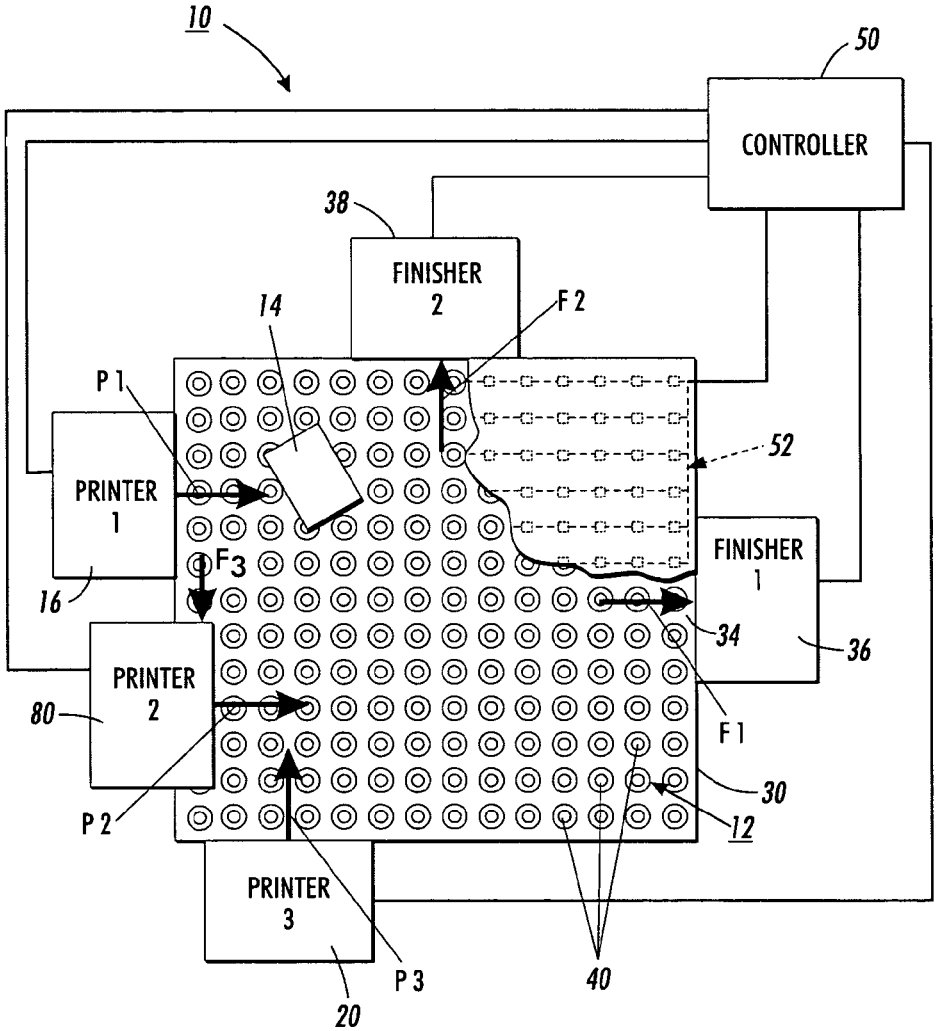
FIG. 3 is a schematic top view of a second embodiment of a multifunction flexible media interface system.

While in FIG. 1, processors are described as being either input (i.e., feeding sheets to the interface 12) or output (i.e., receiving sheets from the interface 12) it will be appreciated that one or more processors may serve as both input and output processors. For example, as shown in FIG. 3, where similar elements are accorded the same numerals, processor 80, a printer in the illustrated embodiment, feeds sheets to the interface 12 via input path P2 and receives sheets via output path F3.

FIGS. 4-9 show alternative embodiments of flexible integration systems which can be assembled with input and output processors, sheet transports 40, and sensor modules 54 analogously to the embodiment of FIG. 1. For convenience, the controller 50 and sensor system 54 are not illustrated in these drawings.

Figure 4:
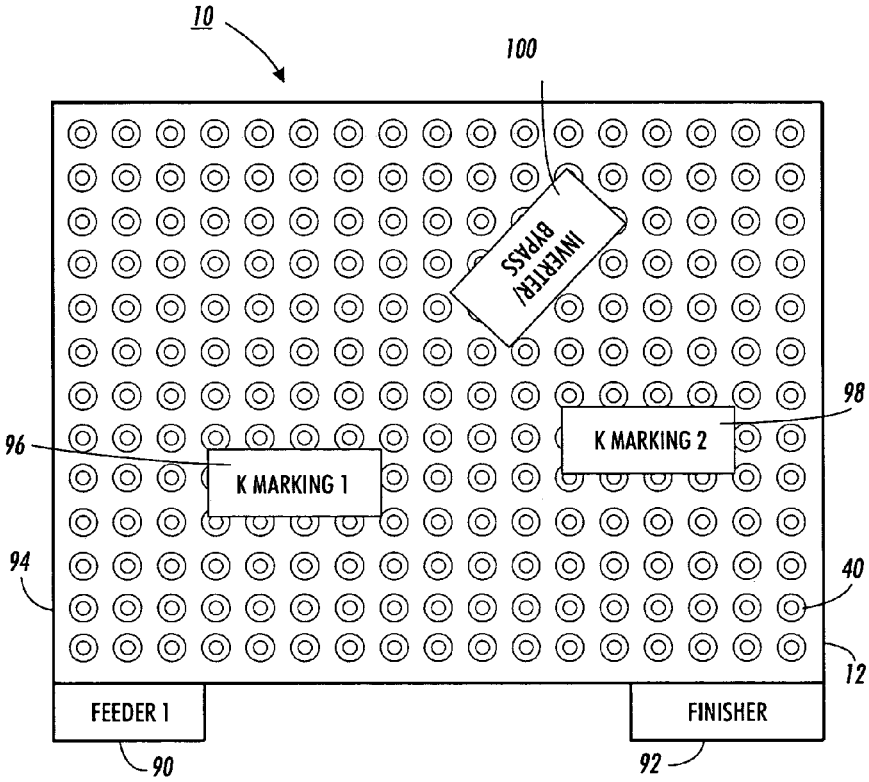
FIG. 4 is a schematic top view of a third embodiment of a multifunction flexible media interface system.
Figure 5:
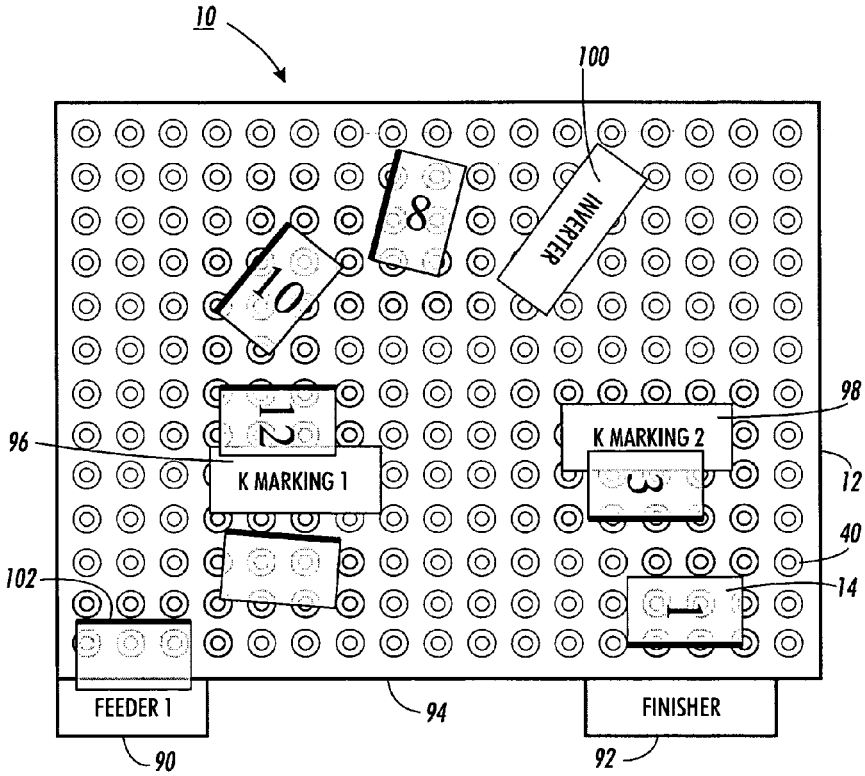
FIG. 5 is a schematic top view the multifunction flexible media interface system of FIG. 4, illustrating marking of sheets in a duplex mode at a single moment in time.
Figure 6:
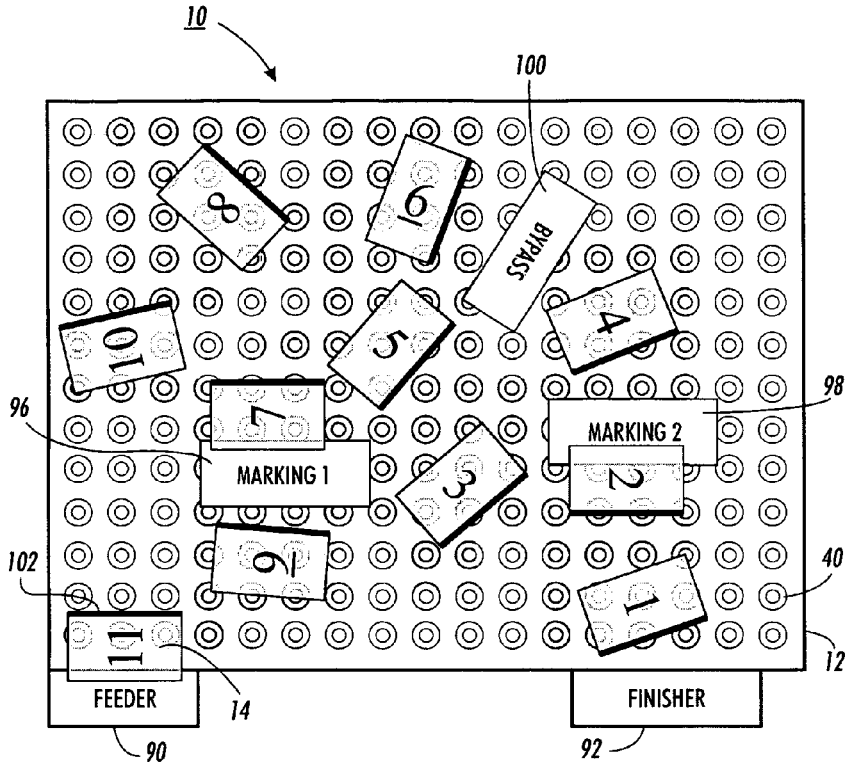
FIG. 6 is a schematic top view of the multifunction flexible media interface system of FIG. 4, illustrating marking of sheets in a simplex mode at a single moment in time.

In FIG. 4, in addition to having input and output processors, here represented by a feeder 90 and a finisher 92, located adjacent a periphery 94 of the interface 12, additional processors 96, 98, 100 are distributed within the interface 12 and serve as input/output processors (receiving sheets from and feeding sheets to the interface). In the illustrated embodiment, processors 96 and 98 are both printers, such as black printers, which are spaced from each other by a portion of the interface 12. Both printers 96, 98 can receive sheets from the same feeder and feed printed sheets onto the interface to be delivered directly or indirectly to the finisher 92. Processor 100 is an inverter/bypass. Such a system 10 can be operated in both simplex and duplex modes. FIG. 5 illustrates operation of the embodiment of FIG. 4 in a duplex mode during a printing job and FIG. 6, illustrates operation in a simplex mode, both showing a snapshot of a job at in time. The numbers on the sheets 14 represent the order in which the pages will appear in the final compiled document. An edge strip 102 is illustrated on each of the pages to demonstrate the orientation of the sheets.

In the duplex mode (FIG. 5) the sheets are routed by the controller 50 from the feeder 90 to the first and second marking units 96, 98 in sequence. In this embodiment, pages 1 and 2 are formed on opposed sides of a single sheet 14. The even numbered pages 2, 4, 6, 8, etc. are printed by the first marking unit 96 and the odd numbered pages 1, 3, 5, etc. are printed by the second marking unit 98. In the duplex mode, the bypass/inverter 100 is active as an inverter, inverting the sheets that have been printed by the first marking unit 96 prior to marking on the opposed sides by the second marking unit 98. The sheets are then routed to the finisher 92 for binding, stapling, or the like.

In the simplex mode (FIG. 6), the sheets are routed by the controller to one of the marking units 96, 98. For example, odd numbered pages are routed to the first marking unit 96, while even numbered pages are routed to the second marking unit 98. The controller routes the two streams from the respective marking units 96, 98 to ensure that the sheets are ordered in sequence 1, 2, 3, etc. prior to reaching the finisher 92. The inverter/bypass 100 functions simply as a bypass.

Figure 7:
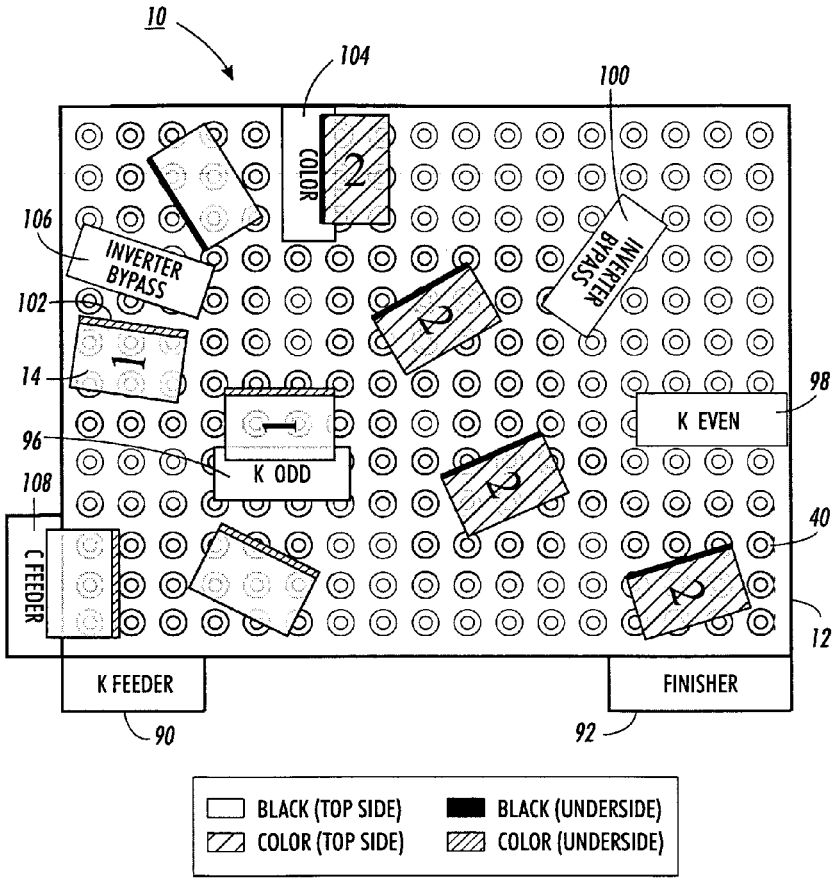
FIG. 7 is a schematic top view of a fourth embodiment of a multifunction flexible media interface system illustrating the path of a single sheet of paper as it is transported on a large area planar multifunction printed sheets interface system to a black printer and, after inversion, to a color printer where the numerals 1 and 2 identify the opposed printed sides of the sheet.
Figure 8:
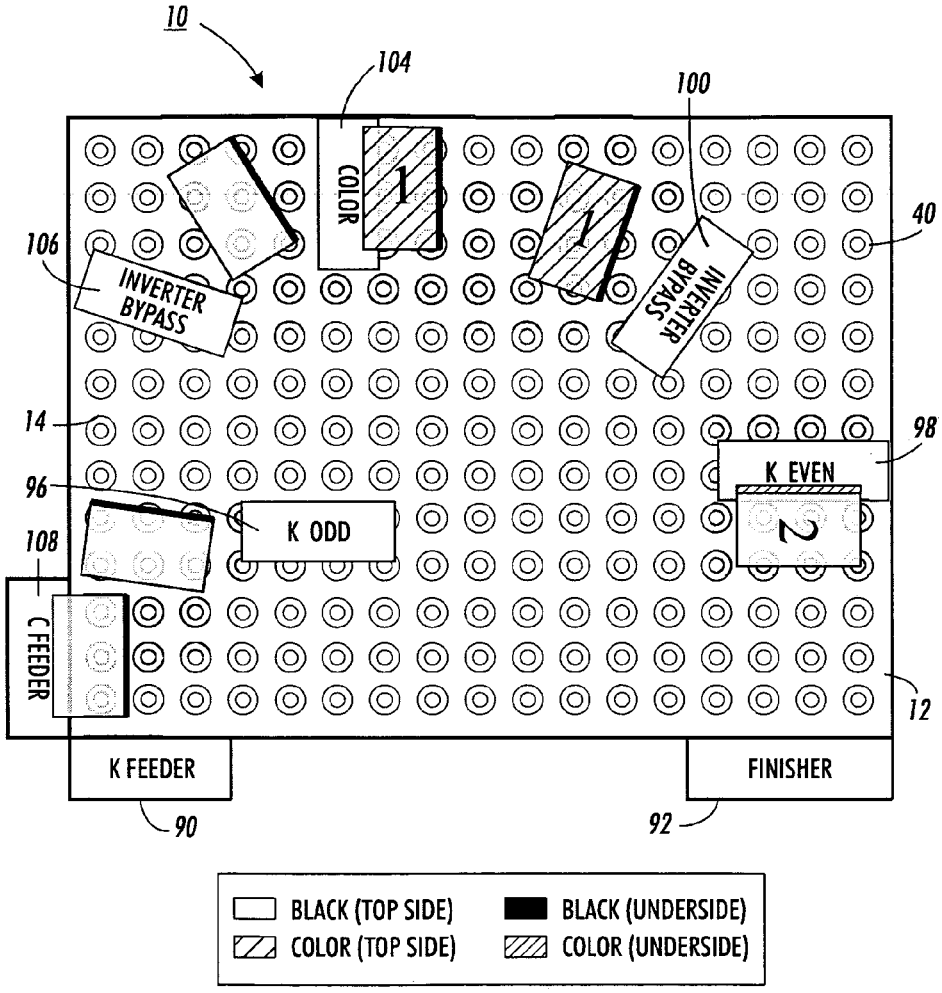
FIG. 8 is a schematic top view of the multifunction flexible media interface system of FIG. 7, illustrating marking of a sheet on a color printer, followed by inversion and subsequent printing of the opposite side on a black printer where the numerals 1 and 2 identify the opposed printed sides of the sheet.

With reference to FIGS. 7 and 8, a configuration of an integration system 10 similar to that of FIGS. 4-6 has additional input/output processors, such as a color marking unit 104 and a second inverter/bypass unit 106. An additional input processor, such as a feeder 108, feeds a stock of paper for the color marking unit. Alternatively, a single feeder feeds the same stock to more than one marking unit. For example, black and color printers may use the same stock. The color unit 104 may be a slower printer than the black and white printers. Such a system 10 is suited to printing operations where most of the business comprises black and white jobs with optionally a few impressions that contain color illustrations. In FIGS. 7 and 8, rather than showing a snapshot in time, the path of a single sheet 14 moving through the system in time is illustrated. The strips 102 indicate what will be (or has been) printed on the underside of each sheet.

In an exemplary duplex mode, illustrated in FIG. 7, sheets are marked in black on their odd sides and in color on their even sides. The sheets 14 are fed by color feeder 108 and are routed first to black marking module 96 where they are printed on their odd sides, illustrated by numeral 1. The sheets follow the path shown to inverter 106 where they are inverted and are routed to color marking unit 104 for printing on their even sides, illustrated by numeral 2. The duplexed sheets are routed to the finisher 92, for binding, stapling, or the like. Bypass/inverter 100 and marking unit 98 are not used in this embodiment.

In an alternative embodiment, illustrated in FIG. 8, the same integration system 10 can be used to print black on the even sides, using "even" marking unit 98, and color on the odd sides, using color marking unit 104. In this embodiment, the inverter 100 is used to invert sheets to be printed by the second black marking unit 98 after printing the color images on the odd sides.

It will be appreciated that the integration system of FIGS. 7 and 8 can be used for printing odd pages 1,3, etc. in black using the "odd" marking unit 96 and even pages 2,4, etc., which are also to be marked in black, on the "even" marking unit 98 in a single job. The color marking unit 104 prints all the color impressions. Additionally, the same side of a sheet may be printed in more than one modality, e.g., in both black and color, or by different printers of the same modality, e.g., two black printers, by using the inverter/bypass 100 and/or 106 in the bypass mode.

The system 10 of FIGS. 7 and 8 can be used for "black only" duplex or simplex printing in a similar manner to that described for FIGS. 5 and 6.

Where a larger proportion of the sheets are to be printed in color, it will be appreciated that one or more color marking units may readily be added.

FIG. 9 illustrates an integration system in which two or more (four in the illustrated embodiment) integration systems 10 are combined to provide higher capacity. Two or more tables 30 are joined together, allowing paper to travel from one table to another. Shown in FIG. 9 are eight (higher speed) black and white printers 120, 122, 124, 126, 128, 130, 132, 134 and two (slower speed) color printers 136, 138. The system also includes four black and white feeders 140, 142, 144, 146 and two color stock feeders 148, 150, as well as two high capacity finishers 152, 154. Six bypass/inverters 156, 158, 160, 162, 164, 166 are positioned at various locations. As can be seen, a single input or output processor, such as finishers 152 and 154 can input/receive sheets from more than one table 30.

It will be readily appreciated that the integration system 10 is not limited to the embodiments shown and described herein but may be configured in a wide variety of arrangements.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A multifunction flexible media interface system comprising:

a plurality of flexible media input areas for receiving flexible media from a plurality of associated input processors;

a plurality of flexible media output areas for providing outputs to different associated flexible media output processors;

a flexible media position sensing system; and a reconfigurable flexible media transporting system comprising a multiplicity of spaced and independently operable, variable flexible media-feeding-direction, flexible media transports and a plurality of modular units which together define a plane, each of the modular units comprising at least one of the independently operable, variable-direction, flexible media transports providing variable angle driving for selectable flexible media rotation and translation of flexible media in the plane, each of the modular units being selectively linkable with other modular units to define the flexible media transporting system.

2. The multifunction flexible media interface system of claim 1, wherein said flexible media transporting system additionally provides selectable flexible media merging in a selected sheet sequence of sheets from said plurality of flexible media input processors to a selected flexible media output processor.

3. The multifunction flexible media interface system of claim 1, wherein said independently operable variable-flexible media-feeding-direction flexible media transports selectively transport flexible media in at least a first direction and a second direction, the second direction being angularly spaced from the first direction.

4. The multifunction flexible media interface system of claim 3, wherein said independently operable variable-flexible media-feeding-direction flexible media transports selectively transport flexible media in a multiplicity of angularly spaced directions.

5. The multifunction flexible media interface system of claim 1, wherein said flexible media transporting system comprises a generally planar flexible media feeding table larger than the dimensions of any sheet to be fed thereon for simultaneous variable transport of a plurality of flexible media thereon.

6. The multifunction flexible media interface system of claim 1, wherein said flexible media transporting system has a large planar area, said large planar area being substantially larger than the dimensions of any sheet to be fed thereon to allow simultaneous plural flexible media variable transport thereon by said multiplicity of spaced apart independently operable variable flexible media feeding direction and flexible media velocity flexible media transports, said flexible media being sensed thereon by said flexible media position sensing system.

7. The multifunction flexible media interface system of claim 6, wherein the planar area is of sufficient dimensions to accommodate simultaneously a plurality of the flexible media to be fed thereon.

8. The multifunction flexible media interface system of claim 1, further comprising a controller associated with said flexible media position sensing system controlling said multiplicity of spaced apart independently operable variable flexible media feeding direction and flexible media velocity flexible media transports.

9. The multifunction flexible media interface system of claim 1, wherein the flexible media comprises sheets of paper.

10. The multifunction flexible media interface system of claim 1 wherein the flexible media comprise printed sheets.

11. A multifunction flexible media integration system comprising:

the flexible media interface system of claim 1;

a plurality of input processors; and a plurality of output processors.

12. The multifunction flexible media integration system of claim 11, wherein at least one of said flexible media output processors is a multifunction processor which functions as both a flexible media output processor and a flexible media input processor.

13. The multifunction flexible media integration system of claim 11, wherein said multifunction processor receives flexible media from another of said output processors and supplies flexible media to one of said input processors.

14. The multifunction flexible media integration system of claim 11, wherein the input processors are selected from marking devices, flexible media feeders, and combinations thereof.

15. The multifunction flexible media integration system of claim 11, wherein the output processors are selected from marking devices, finishers, and combinations thereof.

16. The multifunction flexible media integration system of claim 11, wherein at least one of said plural input and output processors is surrounded on at least three sides by the flexible media interface system.

17. A method of conveying flexible media between a plurality of input processors and a plurality of output processors comprising:

providing the multifunction interface of claim 1;

inputting flexible media to a selected one of the plurality of flexible media input areas, each of the input areas being associated with an input processor;

delivering the received flexible media from the selected one of the plurality of flexible media input areas to a selected one of the plurality of flexible media output areas, each of the flexible media output areas being associated with an output processor, including:

sensing a position of the flexible media, whereby selectable translation of flexible media from any one of the plurality of flexible media input areas to any one of the plurality of flexible media output areas is achieved.

18. The method of claim 17, further including:

after the step of inputting the flexible media, sorting the flexible media according to one or more of size and shape into a plurality of sets of flexible media, the step of delivering the received flexible media including delivering a first set of the sorted flexible media to a first of the flexible media output areas and delivering a second set of the flexible media to a second of the flexible media output areas.

19. The multifunction flexible media interface system of claim 1, wherein the flexible media interface is modular, scalable, reconfigurable, adapted for interfacing with at least one of multiple identical printers and multiple different printers, and capable of providing functionally redundant parallel paper paths connecting said printers with a plurality of the output processors, said interface controlled such that any selected final output to said output processors can be achieved through multiple different sequences of operations, said interface system being optionally capable of at least one of:

processing more than one job simultaneously, and printing sequential images from more than one printer on the same side of a page.

20. A multifunction flexible media interface system comprising:

a plurality of flexible media input areas for receiving flexible media from a plurality of associated input processors;

a plurality of flexible media output areas for providing outputs to different associated flexible media output processors;

a flexible media position sensing system; and a reconfigurable flexible media transporting system comprising a plurality of modular units which together define a plane, each of the modular units comprising at least one independently operable, variable-direction, flexible media transport providing variable angle driving for selectable flexible media rotation and translation of flexible media in the plane, each of the modular units being selectively linkable with other modular units to define the flexible media transporting system, each of the modular units comprising at least one sensor module, the sensor modules being linked together to define the flexible media position sensing system.

21. The multifunction flexible media interface system of claim 20, wherein said flexible media transporting system comprises a multiplicity of spaced and independently operable variable-flexible media-feeding-direction flexible media transports.

* * * * *